US006890405B1

(12) United States Patent
Mah

(10) Patent No.: US 6,890,405 B1
(45) Date of Patent: May 10, 2005

(54) METHOD OF CONTROLLING TACKINESS IN PAPERMAKING

(75) Inventor: Thomas C. C. Mah, Ontario (CA)

(73) Assignee: Manistique Papers, Inc., Manistique, MI (US)

( * ) Notice: Subject to any disclaimer, the term of this patent is extended or adjusted under 35 U.S.C. 154(b) by 17 days.

(21) Appl. No.: 10/704,687

(22) Filed: Nov. 12, 2003

(51) Int. Cl.[7] ..... D21H 17/74

(52) U.S. Cl. ..... 162/173; 162/199; 162/169; 162/181.6; 162/181.7; 162/181.8; 162/147

(58) Field of Search ..... 162/158, 173, 162/181.6–181.8, 169, 147, 199

(56) References Cited

U.S. PATENT DOCUMENTS

| | | | | |
|---|---|---|---|---|
| 5,080,759 | A * | 1/1992 | Buzby et al. | 162/158 |
| 5,139,616 | A * | 8/1992 | Ling | 162/147 |
| 5,936,024 | A * | 8/1999 | Ling et al. | 524/474 |
| 6,150,452 | A * | 11/2000 | Ling et al. | 524/474 |
| 2003/0207639 | A1 * | 11/2003 | Lin | 442/361 |

* cited by examiner

*Primary Examiner*—Jose A. Fortuna
*Assistant Examiner*—Brenda Murphy
(74) *Attorney, Agent, or Firm*—Clark & Brody

(57) ABSTRACT

To reduce the problem of tackiness caused by contaminants in recycled paper, effective amounts of talc and a terpene such as D-limonene are added to paper stock in conjunction with chemical fixing agents and retention aids. The terpene increases the affinity of the contaminants for the talc, thus increasing detackification of the contaminants and improving the productivity of the papermaking process.

10 Claims, No Drawing Sheets

METHOD OF CONTROLLING TACKINESS IN PAPERMAKING

FIELD OF THE INVENTION

The present invention is directed to a method of controlling tackiness during papermaking, and in particular to a method that employs talc and a terpene such as d-limonene during the papermaking process to reduce tackiness of contaminants and enhance the papermaking process productivity.

BACKGROUND ART

The method of making paper is well known in the art. Generally, recovered papers are first defiberized in a pulper with the additions of chemicals in the recycle pulp mill. Then the pulp is subjected to various ink and contaminant removal treatments. In these steps, the majority of the contaminants present in the recovered papers are removed.

After the pulp mill, the cleaned and de-inked pulp is pumped to the paper machine system. In this system, the pulp is further treated with different types of chemicals at the wet end before being fed to the paper machine for paper making. One example of an additive is a retention aid which is designed to increase the retention efficiency of fine materials in the paper formulation. One example of a retention aid is a high mass copolymer of acrylamide. Another additive used is a chemical fixing agent, which is primarily intended to attach contaminants to the paper product. An example of this type of fixing agent is a cationic polyamine or cationic starch. These additives can be added at various locations in the papermaking process. Retention aids are often added downstream of the pressure screen and the fixing agents can be added to thick or thin stock. The fixing agents are added at various locations as well, e.g., before or after the fan pump or into a thick stock stream or chest.

The paper machine consists of three sections—the forming, pressing and drying sections. Through these three sections, the pulp is first drained into wet sheet, then pressed and finally dried into paper in the dryers.

The daily paper machine production and efficiency is affected by many factors, one of these being the unexpected down time due to breaks occurring during papermaking. The breaks could be caused by mechanical defects and/or contaminant deposition in the paper machine.

One particular problem in recycling paper is the use of different grades of recovered papers as the feedstock for pulp preparation. These recovered papers are generally contaminated with different types of undesirable materials. Examples of contaminants are: plastic bags and bottles; box board and old corrugated containers (OCC), metal cans, envelops with glues, coating materials of magazines, different types of adhesives, and hot melt bindings of books and magazines.

The plastic and heavy metal materials can be effectively removed in the recycle plant without any difficulty. Unfortunately, not all the glues, adhesives and coating materials can be removed.

It was found that after pulping, some of the glues, adhesives and coating materials present in the recovered paper become very fine particles (estimated to be between 5–50 um) and are trapped in the pulp being sent to the paper machine. Most of these materials were found to be polyvinyl acetate or PVAc-based contaminants.

PVAc is one of the common synthetic polymers used in the commercial glues and latex applications (other common synthetic polymers being styrene butadiene rubber or SBR and polyacrylate). Latex is also widely used as binder in coated paper manufacturing. The problem with PVAc is that they are sometimes fine in size and difficult to remove using pressure screens.

Most of these PVAc-contaminant particles are not very tacky at the paper machine wet end temperature (115–120 degree F.), and they passed through the forming and pressing sections without causing deposition problem. However, once in the dryer section where the temperature reach up to 265 degree F., the PVAc particles becomes very tacky, depositing on dryer fabrics and dryer cans. This can result in frequent dry end breaks that adversely affect the paper machine production and efficiency.

As such, a need exists to improve the performance of papermaking processes by reducing or eliminating the adhesive affect of the contaminants, particularly during the drying phase of the papermaking process.

One technique that has been proposed in the prior art to reduce the tackiness or "stickies" problem is the addition of talc or bentonite to the papermaking system. However, this technique has not proven to be entirely successful and the stickies still represent a major challenge to the papermaking industry.

The present invention responds to this need by providing an improved papermaking process which reduces the affect of the adhesive or tacky qualities of PVAc particles during the papermaking process, especially the dryer phase.

SUMMARY OF THE INVENTION

It is a first object of the present invention to provide an improved papermaking process.

Another object of the present invention is a papermaking process that controls the tackiness of PVAc particles to reduce or eliminate production slowdowns and disruptions dues to unwanted adhesion caused by the PVAc particles.

Yet another object of the present invention is a method of making paper which uses effective amounts of talc and a terpene such as d-limonene for control of the tackiness of PVAc particles during papermaking.

Other objects and advantages of the present invention will become apparent as a description thereof proceeds.

In satisfaction of the foregoing objects and advantages, the present invention is an improvement in the method of making paper, particularly papermaking techniques that involve recycled paper, high levels of contaminants, and those that use talc or bentonite to treat the contaminants. The invention entails adding an effective amount of a terpene prior to the addition of the talc or bentonite. The use of the terpene enhances the affinity between the contaminants and the talc or bentonite. The terpene can be any terpene but is preferably an orange oil such as D-limonene or a turpentine oil.

Another aspect of the invention for solving the problem of stickies is the use of a chemical fixing agent as an additive in conjunction with the terpene and talc/bentonite additions. The chemical fixing agent can be any of the known types that are cationic starches or cationic polyamine, and it is added either before or after the terpene addition.

One or more retention aids can be added as are conventionally done in papermaking processes after the talc or bentonite has been added.

The process is particularly adapted for papermaking that employs recycled paper as its raw material source, i.e., substantially all of its raw material is derived from recycled paper, since it is these operations that suffer the most from contaminants such as PVAcs.

DESCRIPTION OF THE PREFERRED EMBODIMENTS

The present invention offers significant improvements in methods of making paper, particularly papermaking processes which derive their starting materials from recycled paper stock. This stock is typically laden with impurities and contaminants that can be very disruptive to the papermaking process, and reduce productivity and increase costs. The present invention solves an important problem by detackifying PVAc-particles and contaminants carrying these types of particles. By detackifying these contaminants, the interruptions in the drying phase of papermaking are vastly reduced. While these materials were extremely sticky or tacky at the temperatures typically used during drying, the inventive method essentially detackifies these contaminants so that they cannot disrupt the papermaking process.

In its broadest embodiment, the invention involves an improvement in the papermaking process to effectively control the problem of stickies created by contaminants found in the raw materials used for papermaking. The invention comprises a novel and unique sequence of adding an effective amount of a terpene, preferably d-limonene, to paper stock followed by the addition of an effective amount of talc or bentonite. The use of the terpene enhances the affinity between the contaminants contained in the stock, e.g., PVAcs, and the talc or bentonite. With this affinity, the talc is better able to detackify the PVAcs, which then results in an improved papermaking operation.

In a preferred mode, the talc/bentonite and terpene addition are used in conjunction with chemical fixing agents and retention aids. In one mode, the terpene and talc/bentonite are added between additions of one or more fixing chemical agents and retention aids. In another mode, the fixing chemical agent(s) are added after the terpene addition and prior to the talc/bentonite addition. There are no defined limits for the amount of terpene since the amount could vary with each papermaking process. However, the amount is considered to be a sufficient or effective amount to enhance the affinity of the contaminants to the talc/bentonite to produce effective detackification.

While preferred sequences are disclosed wherein the placement of the chemical fixing agent varies as being before or after the addition of the terpene, the addition of the terpene should precede the addition of the talc or bentonite and the terpene, chemical fixing agent and talc/bentonite additions should precede the retention aid addition.

Based on plant trials, preferred amounts of the terpene addition are believed to range between about 0.2 to up to about 1.0 lbs./ton of pulp. Preferred amounts of the talc/bentonite addition range between 10–50 lbs./ton pulp.

The chemical fixing agents intended for use in the invention are those fixing agents that are commonly used in papermaking processes for attaching contaminants to fines and fibers. The chemical fixing agent helps bind the talc/bentonite—PVAc contaminants to the fines and fibers in the stock. Likewise, retention aids as are commonly used in papermaking can be selected from any of the known agents that are typically used in papermaking for fixing and strength purposes, and retention purposes. Preferred fixing agents are cationic types, either starches or polyamines, and poly-DADMAC. Retention aids can be high molecular weight polyacrylamides. Preferred ranges for these additives include 1.0–3.0 lbs./ton pulp for the cationic polyamines, and 4–10 lbs./ton pulp for the cationic starches. Retention aid amounts also vary depending on the type used; 1–4 lbs./ton pulp for coagulants, and 0.5–2.5 lbs/ton pulp for flocculants.

The inventive control technique for stickies can be applied to any recycled paper mill operation confronted with a paper machine stickies deposition problem. It could potentially make all the existing stickies detackification processes more versatile and effective. The inventive process is particularly valuable to mills that use recycled paper as their sole source of raw material, and those using recycled paper to produce high brightness specialty sheets. Because of the recycled paper raw material, these mills are plagued with PVAc-related deposition problems. By instituting the inventive stickies control scheme, these mills would be able to operate with less dryer deposition problem and improved productivity.

The locations in the papermaking process where the additives are added to the paper stock can vary depending on the exact layout and equipment used in the process. One example of locations would be adding the chemical fixing agent at the stock storage after pulping. The terpene could be added before the machine chest with the talc or bentonite added at the machine chest. The retention aids would be added as typically done in a papermaking process. When using a two component retention aid system, the coagulant would be added before the cleaner, and the flocculant before or after screening.

The invention is a great improvement over processes that used talc alone because talc is only effective in detackifying stickies (i.e. pressure sensitive adhesives), which are tacky under normal paper machine wet end process temperatures. By practicing the invention, stickies control is broadened significantly in the recycled paper mill operations, and enhanced business opportunities are created for the talc and/or bentonite suppliers.

As part of the effort to solve the problem of stickies in papermaking, plant trials were conducted using fixing agents and retentions aids. More specifically, a scheme was proposed that involved two steps. First, the PVAc contaminants were fixed onto fines and fiber with a fixing agent. Then, the PVAc-containing fines and fibers were retained onto sheet with retention aids, thus removing from the papermaking machine system. The intent of this (fixing chemical/retention aid) addition sequences was to remove the PVAc particles with the sheet, thereby reducing their content in the paper machine system and minimizing their tendency to agglomerate into bigger aggregates and deposit in paper machine.

This scheme, however, was only partially effective as the fine PVAc particles retained on the sheet still become tacky at high temperature in the dryer cans. As a result, the mill continued to be confronted with paper machine deposition and break problem.

An alternative approach was designed to overcome the problem by the use of talc and/or bentonite. Talc and bentonite are known hydrophobic minerals, which are widely used in the paper industries for stickies control. Two trials with talc and bentonite were conducted with the first trial using talc only. Talc was added to the pulp before the retention aid addition and no fixing chemical was added (i.e. the talc/retention aid sequence). In the second trial using bentonite, bentonite was added to the machine chest after a chemical fixing agent addition and this was followed by the retention aid addition (i.e. the fixing chemical/bentonite/retention aid sequence). Both trials, however, were not successful and their additions did not help to reduce the paper machine deposition and breaks. A potential reason for the failures was thought to be that the PVAc particles were not tacky at the paper machine wet end temperature (115–120 degree F.). As a result, there was little affinity between the talc and PVAc particles and most of the PVAc particles during the trials could remain uncoated and undetackified.

Another trial was conducted embodying the invention. In this trial, an orange oil based dispersant (commercially availably as Dyasol, a mix of 30% D-limonene, 1% surfactant and the balance water) was added to the pulp before the talc addition. The oil component of Dyasol would attach to the PVAc particle surfaces making them highly hydrophobic and more readily coated with talc and detackified.

Two addition sequences were tried in two different paper mills. In each sequence, a fixing chemical or agent and retention aids were added with the D-limonene addition.

In Mill No. 1, the sequence of addition was fixing chemical/Dyasol/talc/and retention aids. The fixing chemical was a cationic polyamine (Bufloc 384 from Buckman), the retention aid was a single component cationic polyacrylamide from Versa Chemical. The chemical fixing agent rate of addition was 1.5–2.5 lbs./ton pulp. The retention aid addition was 0.5–1.0 lbs./ton pulp. The Dyasol addition rate was 0.3–0.5 lbs./ton pulp. The talc addition rate was 30–45 lbs./ton pulp.

In Mill No. 2, the sequence of addition was Dyasol/fixing chemical/talc/retention aids. The chemical fixing agent was a modified starch with a cationic charge (Raisabond from Raiso Chemical), two retention aids were used, a coagulant and a flocculant. The coagulant was a cationic polyamine (Bufloc 5132 from Buckman) and the flocculant was a cationic polyacrylamide from Buckman. The fixing chemical rate of addition was 1.5–2.5 lbs./ton pulp. The coagulant addition was 5.0–8.0 lbs./ton pulp. The flocculant addition was 1.0–2.0 lbs./ton pulp. The Dyasol addition rate was 0.25–0.4 lbs./ton pulp. The talc addition rate was 25 lbs./ton pulp.

Both chemical addition sequences were found to work very well and significantly reduced the paper machine deposition and breaks. As a result, the paper machines in both mills were able to operate with fewer breaks and improved efficiencies.

These trials clearly demonstrated that the Dyasol was indeed effective in enhancing the affinity between PVAc particles and talc—a condition required for the successful detackification of PVAc with talc.

It should also be noted that trials conducted at Mill No. 1 used sequences of adding Dyasol/talc/retention aids. While these trials showed that the use of the D-limonene with the talc improved the operation in terms of stickies and the trials were somewhat effective, better performance should still be sought. In another trial, the sequence of adding fixing chemical/talc/retention aids resulted in very poor results, and clearly showed that talc alone was ineffective for stickies control. The reason optimum performance was obtained when using the chemical fixing agents was that the detackified contaminants, e.g., the PVAcs treated with the terpene and talc are effectively bound or attached to the fines and fibers by the fixing agent so that they would be retained on the paper sheet and kept out of the paper machine system. Thus, fixing chemical plays an important role in optimizing the success of these PVAc control schemes, although the fixing agents could be optional if the levels of contaminants were such that the terpene and talc would effectively eliminate the stickies problem. As noted above, the fixing agents attach the detackified PVAc particles onto fines and fibers and allowed them to be more easily retained onto sheets with the retention aid addition. As a result, there were less free PVAc contaminants being recycled around in the paper machine system. This minimized the PVAc particles agglomeration problem—another factor to increased paper machine deposition.

While D-limonene in the form of Dyasol has been found to be effective in reducing the stickies problem in papermaking, it is believe that since D-limonene is a terpene, that other terpenes could also be employed in place of D-limonene as an effective additive with the talc, e.g., turpentine oil. As mentioned above, it is also believe that while certain levels of the various additives worked in conjunction with the mill trials, other amounts could also prove effective in treating the stickies problem faced by the papermaking industry. Thus, it is believed that the amount of terpene, talc, fixing chemicals and retention aids are added in amounts that are effective for stickies control, and this amount may vary depending on the particularities of the papermaking process being used. For example, the two mill trials show that each mill is different in the amount of fixing chemical, retention aid and talc, and the invention does not require absolute amounts of the various additives for it to be effective.

As such, an invention has been disclosed in terms of preferred embodiments thereof, which fulfills each and every one of the objects of the present invention as set forth above and provides a new and improved method of making paper, particularly methods using recycled paper stock.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a method of making paper from raw materials containing contaminants that use talc or bentonite as an additive to detackify contaminants in paper stock, the improvement comprising adding effective amounts of a terpene to increase affinity of the contaminants to the talc or bentonite.

2. The method of claim 1, wherein the terpene is one or D-limonene or turpentine oil.

3. The method of claim 1, wherein a chemical fixing agent is added either before or after addition of the terpene, the chemical fixing agent added in an effective amount to fix the contaminants and the talc or bentonite to fibers and fines in the paper stock.

4. The method of claim 3, wherein an effective amount of one or more retention aids are added during the papermaking method, addition of the retention aid following the steps of adding the talc or bentonite, terpene, and chemical fixing agent.

5. The method of claim 1, wherein the chemical fixing agent is added prior to addition of the terpene.

6. The method of claim 4, wherein the chemical fixing agent is added after addition of the terpene.

7. The method of claim 3, wherein the chemical fixing agent is added prior to addition of the terpene.

8. The method of claim 3, wherein the chemical fixing agent is added after addition of the terpene.

9. The method of claim 1, wherein an effective amount of a retention aid is added during the papermaking method, addition of the retention aid following the steps of adding the talc or bentonite and terpene.

10. The method of claim 1, wherein the method of making paper uses substantially all recycled paper as raw material.

* * * * *